US007334424B2

(12) United States Patent
Park et al.

(10) Patent No.: US 7,334,424 B2
(45) Date of Patent: Feb. 26, 2008

(54) AIR CONDITIONER HAVING INDEPENDENT COOLING AND PURIFYING PATHS

(75) Inventors: Jun Hyung Park, Asan-si (KR); Jung Hwa Bae, Asan-si (KR); Kwang Oh Moon, Asan-si (KR); Hyoung Bok Jung, Cheonan-si (KR)

(73) Assignee: WiniaMando Inc., Asan-si (KR)

( * ) Notice: Subject to any disclaimer, the term of this patent is extended or adjusted under 35 U.S.C. 154(b) by 286 days.

(21) Appl. No.: 11/254,606

(22) Filed: Oct. 19, 2005

(65) Prior Publication Data

US 2006/0086138 A1 Apr. 27, 2006

(30) Foreign Application Priority Data

Oct. 22, 2004 (KR) ..... 10-2004-0084644
Dec. 31, 2004 (KR) ..... 10-2004-0118418
Apr. 6, 2005 (KR) ..... 10-2005-0028408

(51) Int. Cl.
*F25D 17/06* (2006.01)
*B01L 1/04* (2006.01)

(52) U.S. Cl. ..... 62/428; 454/187

(58) Field of Classification Search ..... 62/180, 62/186, 310, 314, 317, 428, 419; 454/156, 454/187; 96/223; 422/120, 186.04
See application file for complete search history.

(56) References Cited

U.S. PATENT DOCUMENTS 5,140,830 A * 8/1992 Sawyer ..... 62/298
6,715,310 B2 * 4/2004 Kuo ..... 62/262
2001/0045159 A1 * 11/2001 Johnson et al. ..... 95/26
2002/0078703 A1 * 6/2002 Kim ..... 62/298
2002/0094298 A1 * 7/2002 Monagan ..... 422/5
2002/0134087 A1 * 9/2002 Urch ..... 62/3.2
2004/0040313 A1 * 3/2004 Kurokawa et al. ..... 60/796
2004/0144249 A1 * 7/2004 Kang et al. ..... 95/1
2004/0247497 A1 * 12/2004 Yuen ..... 422/186.3
2005/0005585 A1 * 1/2005 Kim ..... 55/467.1
2005/0204922 A1 * 9/2005 Wu et al. ..... 96/66
2006/0005705 A1 * 1/2006 Yuen ..... 96/16
2007/0157813 A1 * 7/2007 Spiegel ..... 96/15

FOREIGN PATENT DOCUMENTS

JP 3-44885 A * 2/1991
KR 1020000056954 A 9/2000
KR 1020040025269 A 3/2004

* cited by examiner

*Primary Examiner*—Mohammad M. Ali
(74) *Attorney, Agent, or Firm*—John P. White; Cooper & Dunham LLP

(57) ABSTRACT

Disclosed herein is an air conditioner having independent cooling and purifying paths. The air conditioner comprises a body casing formed by assembling a front panel with a rear panel, the front panel having a cooled air discharge opening and one or more suction openings to introduce indoor air into the body casing, a first fan arranged in the body casing to suction air via the suction openings, and a heat exchanger located above the first fan to perform heat exchange of the suctioned air. A cooler housing is arranged in the body casing to receive the first fan therein. Also, an air purifier is mounted in the body casing.

16 Claims, 10 Drawing Sheets

AIR CONDITIONER HAVING INDEPENDENT COOLING AND PURIFYING PATHS

BACKGROUND OF THE INVENTION

1. Field of the Invention

The present invention relates to an air conditioner having independent cooling and purifying paths. More particularly, the present invention relates to an air conditioner wherein a cooling path, which consists of one or more air suction openings, a first fan, a heat exchanger, and a cooled air discharge opening, is independently formed of a purifying path, which consists of a front suction cover, an air purifier suction opening; a second fan, a pair of purified air discharge openings, and a pair of lateral discharge covers, whereby, in use of the air conditioner, air purifying and room cooling operations can be independently or simultaneously carried out in accordance with a user's selective manipulation.

2. Description of the Related Art

In general, air conditioners are representative consumer electronics employing a refrigeration system. The air conditioners may be classified, in accordance with a structure thereof, into integral-type air conditioners in which an indoor unit and an outdoor unit are integrally formed, and separated-type air conditioners in which an indoor unit and an outdoor unit are separated from each other, and also may be classified, in accordance with an installing manner thereof, into floor-standing type air conditioners and wall-mounted type air conditioners.

Among separated-type air conditioners, floor-standing type air conditioners have a higher cooling capability than wall-mounted type air conditioners, and thus, are generally used in relatively large living rooms or offices.

As well known, an air conditioner is an appliance that mainly functions to cool a room. However, there has recently gained popularity a combined air conditioner capable of performing an air purifying function in addition to a cooling function.

A conventional combined air conditioner is generally designed so that an electric dust collector and a mesh filter are mounted on the inside of a suction grill to perform an auxiliary air purifying function.

However, the conventional air conditioner having the above described simple configuration has a problem in that the mesh filter and the dust collector, mounted in the air conditioner, cannot be independently utilize. That is, the mesh filter and the dust collector are operable only during operation of the air conditioner.

This results in several disadvantages including a restriction in a utilization scope of the air conditioner and a necessity of additional electricity consumption.

Furthermore, since the mesh filter has approximately the same size as the suction grill and thus is arranged to cover a suction opening completely, and the electric dust collector is approximately one half the size of the suction grill, the conventional air conditioner achieves poor air purification and dust collection, and suffers from operational noise due to increased flow resistance.

As a solution to overcome the above-described problems, Korean Patent Publication No. 10-2004-0025269 discloses an air conditioner having an air purifying function.

A main facet of the disclosed technology is that an air purifier is mounted in a space defined between an air suction opening and a cooled air discharge opening to allow cooled air to be independently utilized in a region except for a predetermined cooling path and to prevent contamination of the cooled air. With this disclosed technology, it is possible to prevent generation in flow resistance of air and to facilitate installation/separation of the air purifier.

However, the conventional air conditioner has a problem in that a cooling path and a purifying path of the air conditioner are practically joined together in accordance with the structure and characteristics of products, in spite of the fact that an air purifier housing that constitutes the air purifier and a cooler housing that contains a cooling fan are defined individually.

SUMMARY OF THE INVASION

Therefore, the present invention has been made in view of the above problems, and it is an object of the present invention to provide an air conditioner wherein a cooling path, which consists of one or more air suction openings, a first fan, a heat exchanger, and a cooled air discharge opening, is independently formed of a purifying path, which consists of a front suction cover, an air purifier suction opening, a second fan, a pair of purified air discharge openings, and a pair of lateral discharge covers, whereby, in the use of the air conditioner, air purifying and room cooling operations can be independently or simultaneously carried out in accordance with a user's selective manipulation.

In accordance with a first aspect of the present invention, the above and other objects can be accomplished by the provision of an air conditioner having independent cooling and purifying paths, comprising: a body casing consisting of a front panel and a rear panel assembled with each other, a first fan arranged in the body casing to suction air, and a heat exchanger located above the first fan to perform heat exchange of the suctioned air, wherein the cooling path includes one or more suction openings formed at a lower section of the body casing and a discharge opening formed at a front side of an upper section of the body casing, wherein the purifying path includes an air purifier suction opening, which is formed at a lateral location or a center location of the front side of the body casing, and a pair of purified air discharge openings, which are formed at opposite lateral sides of the body casing, and wherein the cooling path is separated from the purifying path to be independently formed from each other.

Preferably, a pair of suction openings of the cooling path may be formed at opposite lateral sides of the front panel to be located in the lower section of the body casing.

Preferably, a single suction opening of the cooling path may be formed at a front side of the front panel to be located in the lower section of the body casing.

In accordance with a second aspect of the present invention, the above and other objects can be accomplished by the provision of an air conditioner having independent cooling and purifying paths, comprising: a body casing formed by assembling a front panel with a rear panel, the front panel having a cooled air discharge opening and one or more suction openings to introduce indoor air into the body casing; a first fan arranged in the body casing to suction air via the suction openings; and a heat exchanger located above the first fan to perform heat exchange of the suctioned air, wherein a cooler housing is arranged in the body casing to receive the first fan therein: wherein an air purifier is mounted in the body casing, the air purifier including: a purifier housing formed with an air purifier suction opening to suction air and a pair of purified air discharge openings to discharge purified air, separately from the suction openings and the discharge opening; a second fan mounted in the purifier housing to suction air; and a filter member located in front of the air purifier suction opening to filter air, whereby the cooling path, which consists of the suction openings, the first fan, the heat exchanger, and the discharge opening, is independently formed of the purifying path, which consists of the filter member, the air purifier suction opening, the second fan, and the purified air discharge opening.

Preferably, the air purifier suction opening may be opened and closed in accordance with the driving of a front suction cover, which is mounted to slide forward from the body casing, and the purified air discharge openings may be opened and closed in accordance with driving of a pair of lateral discharge covers, which are mounted to rotate at opposite lateral sides of the body casing.

Preferably, the suction openings of the front panel may be formed at opposite lateral sides of the body casing, respectively.

Preferably, the cooler housing and the purifier housing may be integrally formed with each other to be mounted in the body casing.

Preferably, the purifier housing may be positioned at an upper side of the cooler housing.

Preferably, indoor cooling and air purifying operations obtained via the cooling path and the purify path may be independently or simultaneously performed in accordance with a user's selective manipulation Preferably, the front suction cover may be opened and closed by: four cover sliders mounted to slide forward from the front panel to support respective corners of the front suction cover, a pair of first drive motors each attached to a supporting structure provided at an inner surface of the front panel; a pair of pinions each connected to a shaft of one of the first drive motors; and a pair of racks engaged with the pinions, respectively, each rack penetrating through the front panel to be fixed perpendicular to the inner surface of the front suction cover, and each of the lateral discharge covers may be opened and closed by: a second drive motor provided at a side of the lateral discharge cover, and an opening/closing link to transmit a drive force of the second drive motor to the lateral discharge cover.

Preferably, each of the lateral discharge covers may be opened and closed by: a transfer rod having one end fixed to one of the cover sliders; a connecting rod having one end coupled with the other end of the transfer rod; and an opening/closing link provided at the lateral discharge cover to be connected to the other end of the connecting rod, whereby the lateral discharge covers are linked with the front suction cover to be opened and closed in accordance with operation of the front suction cover.

In accordance with a third aspect of the present invention, the above and other objects can be accomplished by the provision of an air conditioner having independent cooling and purifying paths, comprising: one or more suction openings to suction air via a lower panel of a front panel; a discharge opening to discharge cooled air after cooling the air suctioned via the suction openings by use of a heat exchanger, a front suction cover mounted at an upper side of the lower panel to be coupled to and separated from a rear panel, the front suction cover having a separated cover member to define an air purifier suction opening and air purifier suction holes; a filter member mounted on the inside of the front suction cover to filter impurities contained in the suctioned air, an electric dust collector mounted close to the filter member to sterilize and purify air by applying electrical stimulations; a second fan mounted on the inside of the front suction cover to blow air purified by the filter member and the electric dust collector, and a pair of purified air discharge grills to guide the air, blown from the second fan, to discharge it from opposite lateral sides of the front panel.

Preferably, the cover member may be fixed to a front side of the front suction cover by use of a supporting bar.

Preferably, the filter member and the electric dust collector may be configured to be inserted into or be separated from a guide groove, which is defined at an inner surface of the front suction cover by means of a pair of bent guide walls.

Preferably, each of the purified air discharge grills may have fixing protrusions formed at upper and lower surfaces thereof, so that the fixing protrusions are inserted into and rotatably fixed in fixing recesses formed at the front panel.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be explained with reference to the accompanying drawings.

Figure 1:
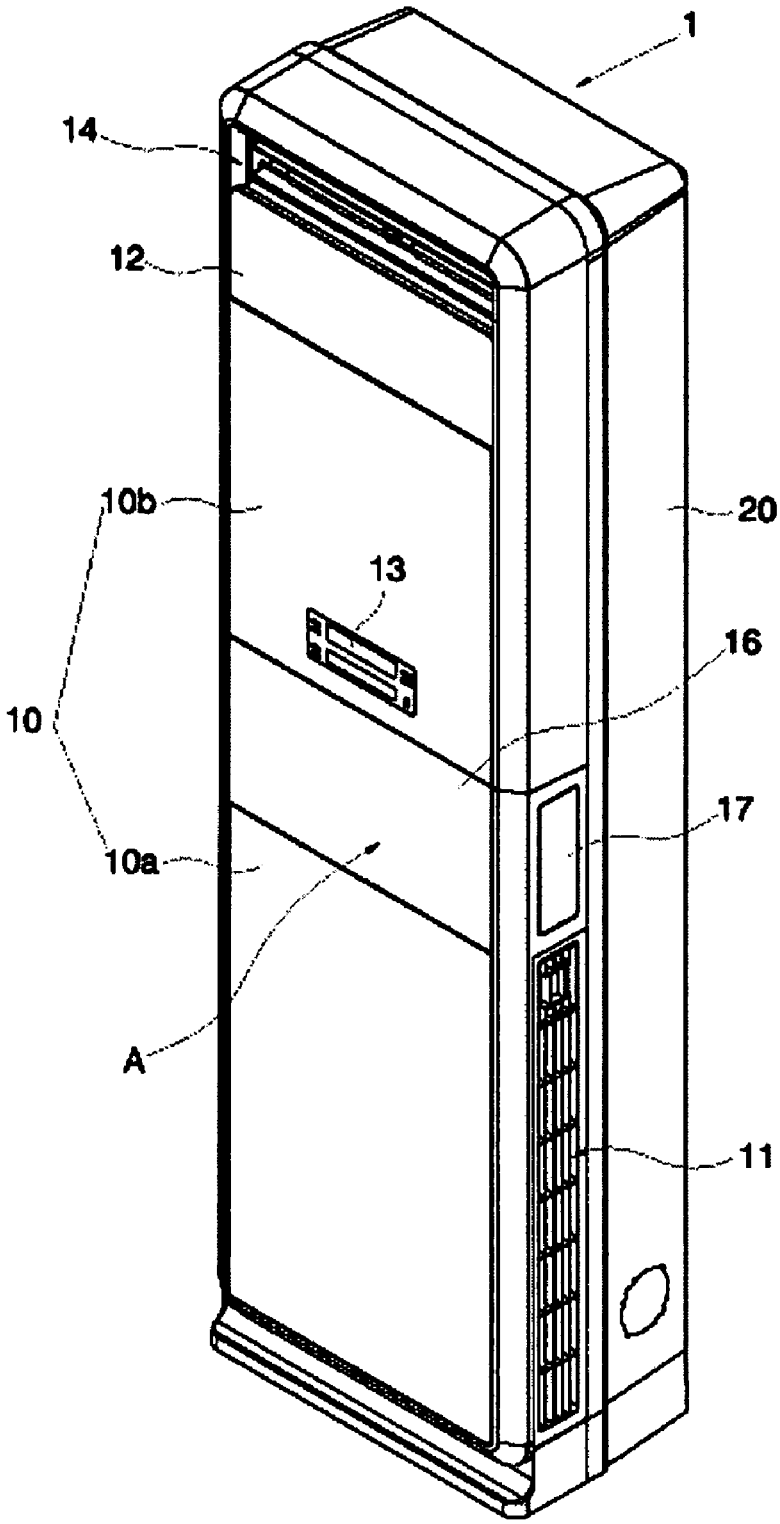
FIG. 1 is a perspective view illustrating the outer appearance of an air conditioner according to the present invention.
Figure 2:
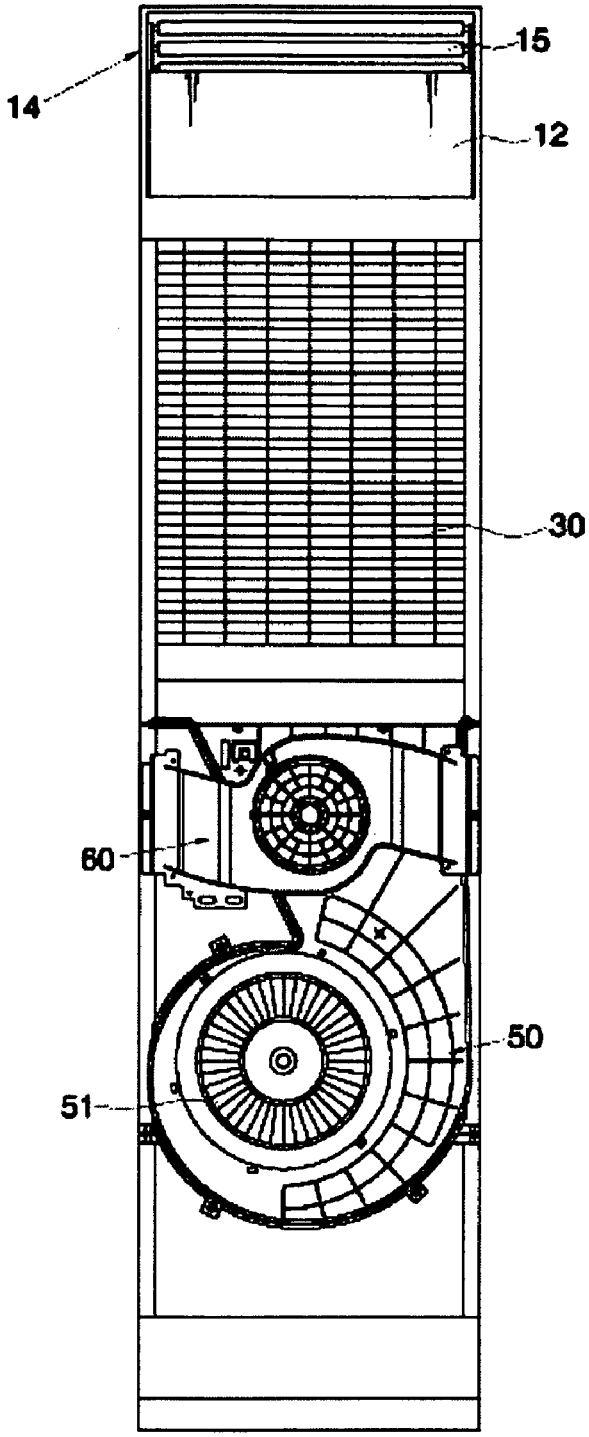
FIG. 2 is a front view schematically illustrating the internal configuration of a body casing shown in FIG. 1.
Figure 3:
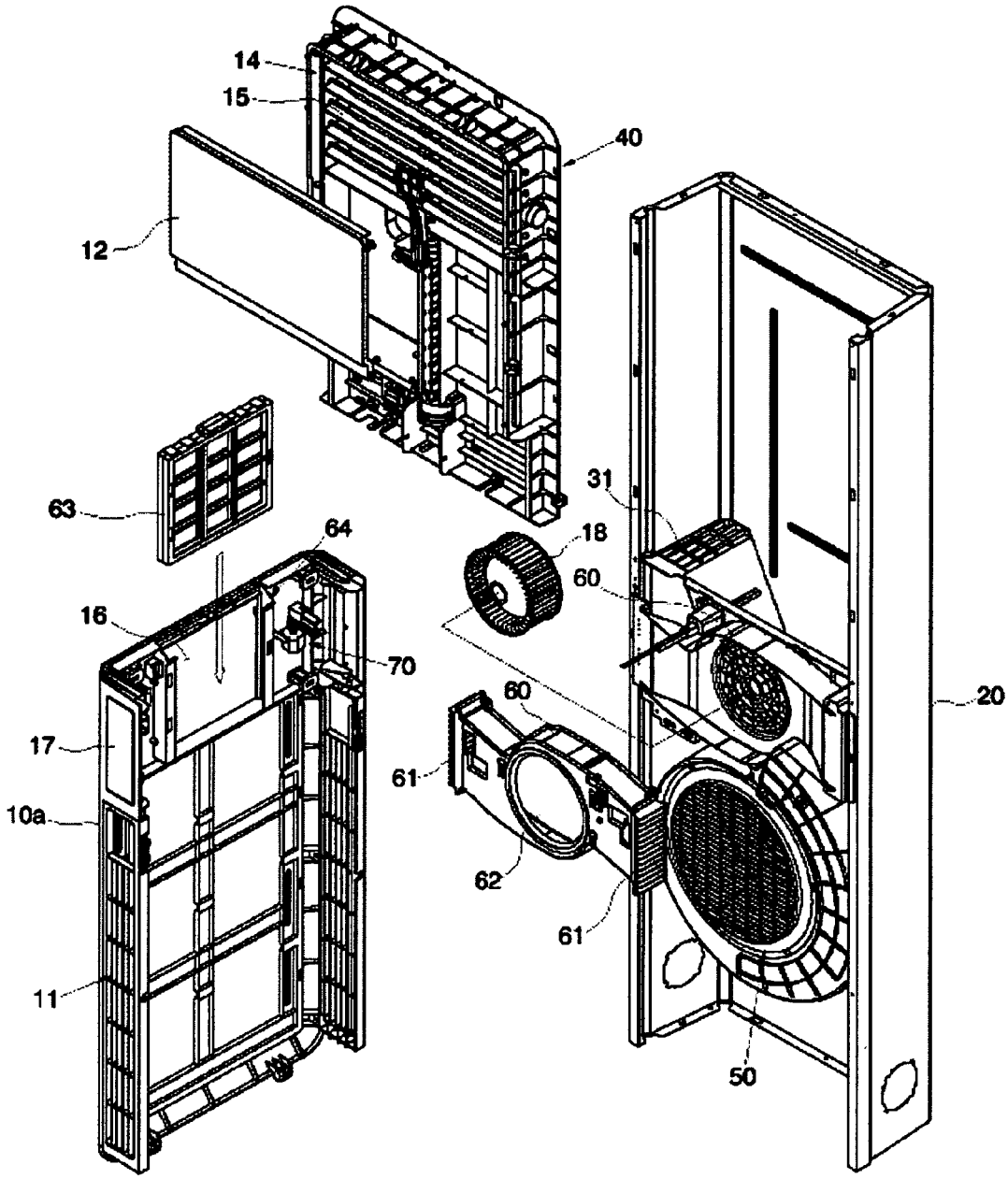
FIG. 3 is an exploded perspective view illustrating important parts of the air conditioner of FIG. 1.
Figure 4:
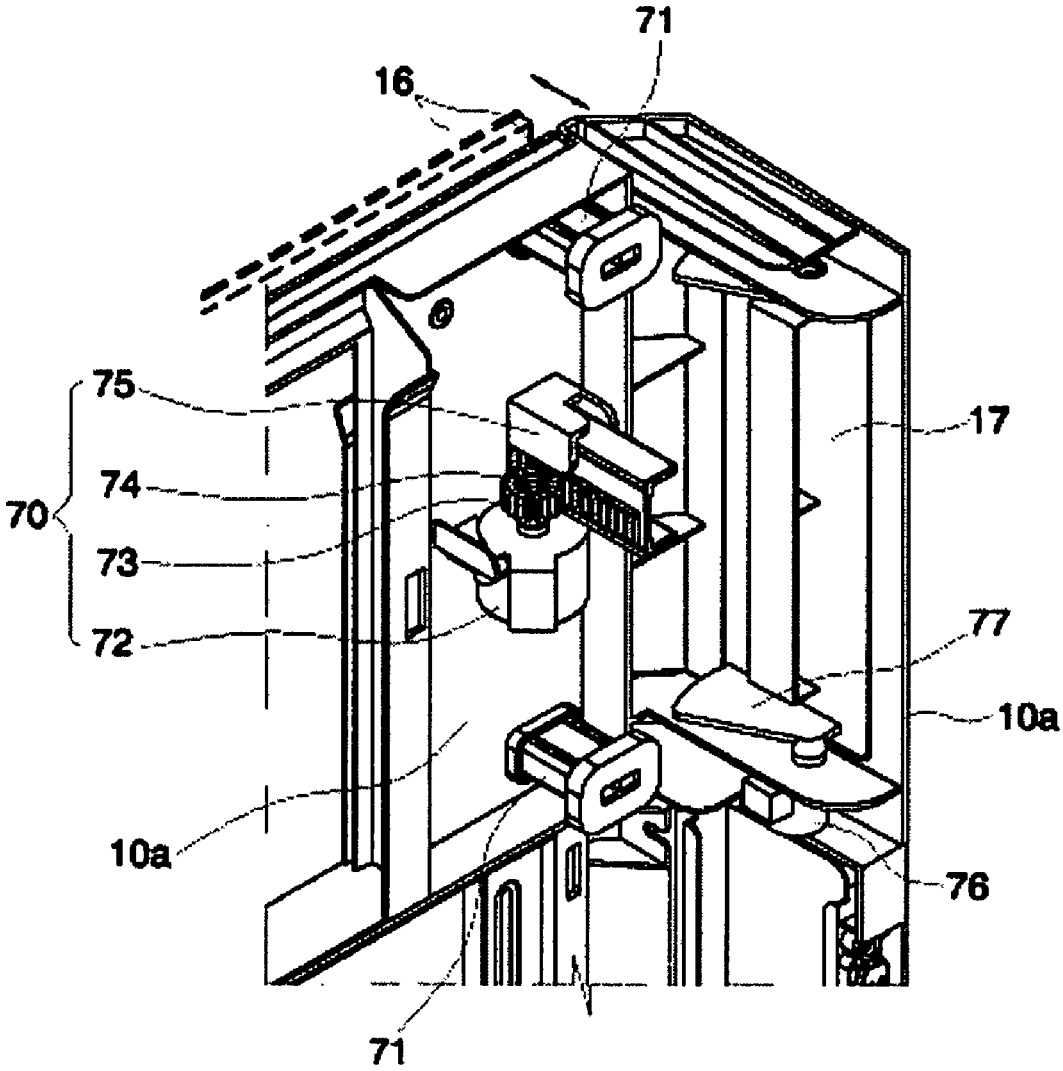
FIG. 4 is a partial perspective view illustrating configuration of important parts used to open and close an air purifier employed in the air conditioner according to the present invention.
Figure 5:
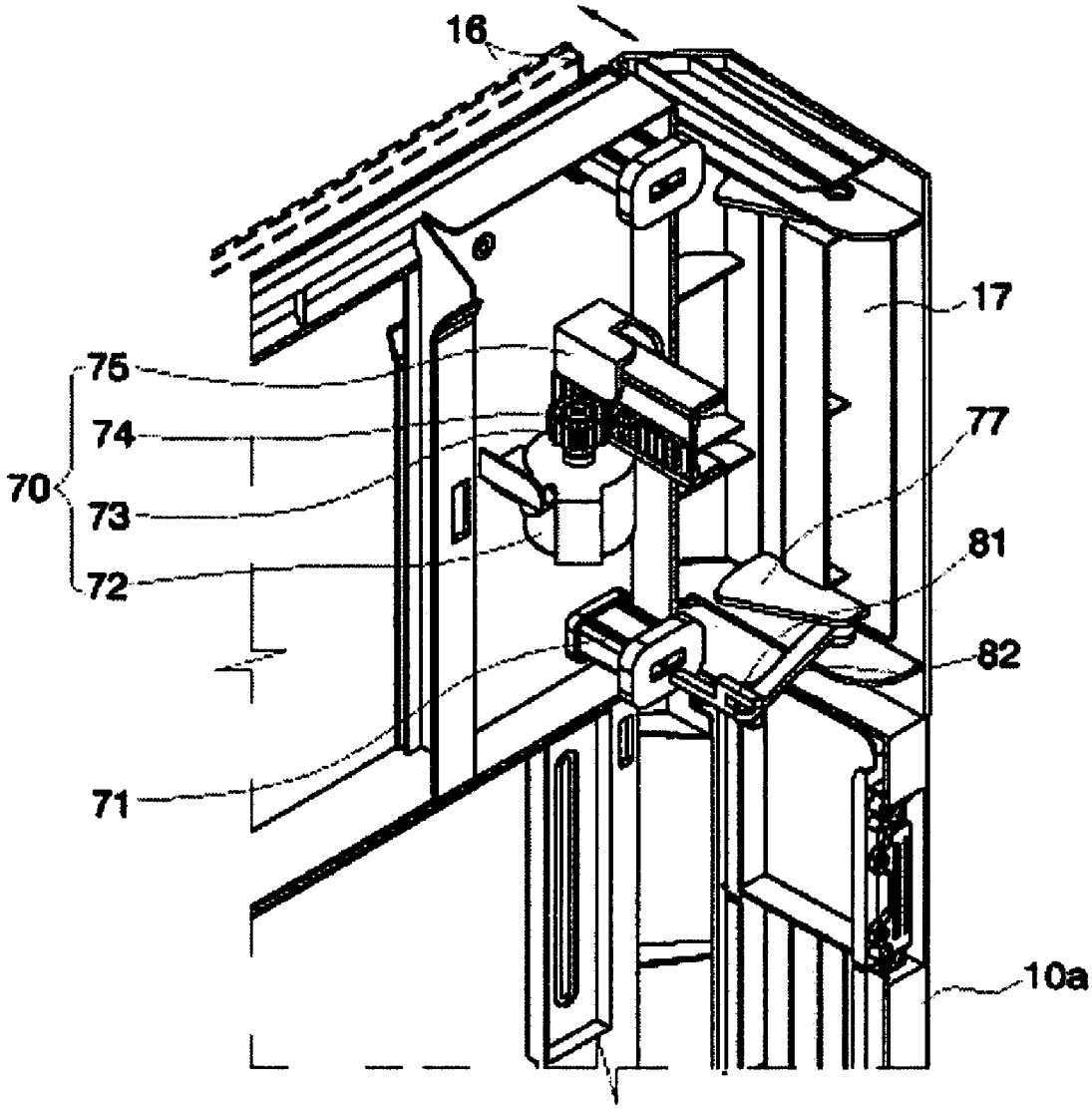
FIG. 5 is a partial perspective view illustrating configuration of important parts used to open and close an air purifier employed in the air conditioner according to an alternative embodiment of the present invention.
Figure 6:
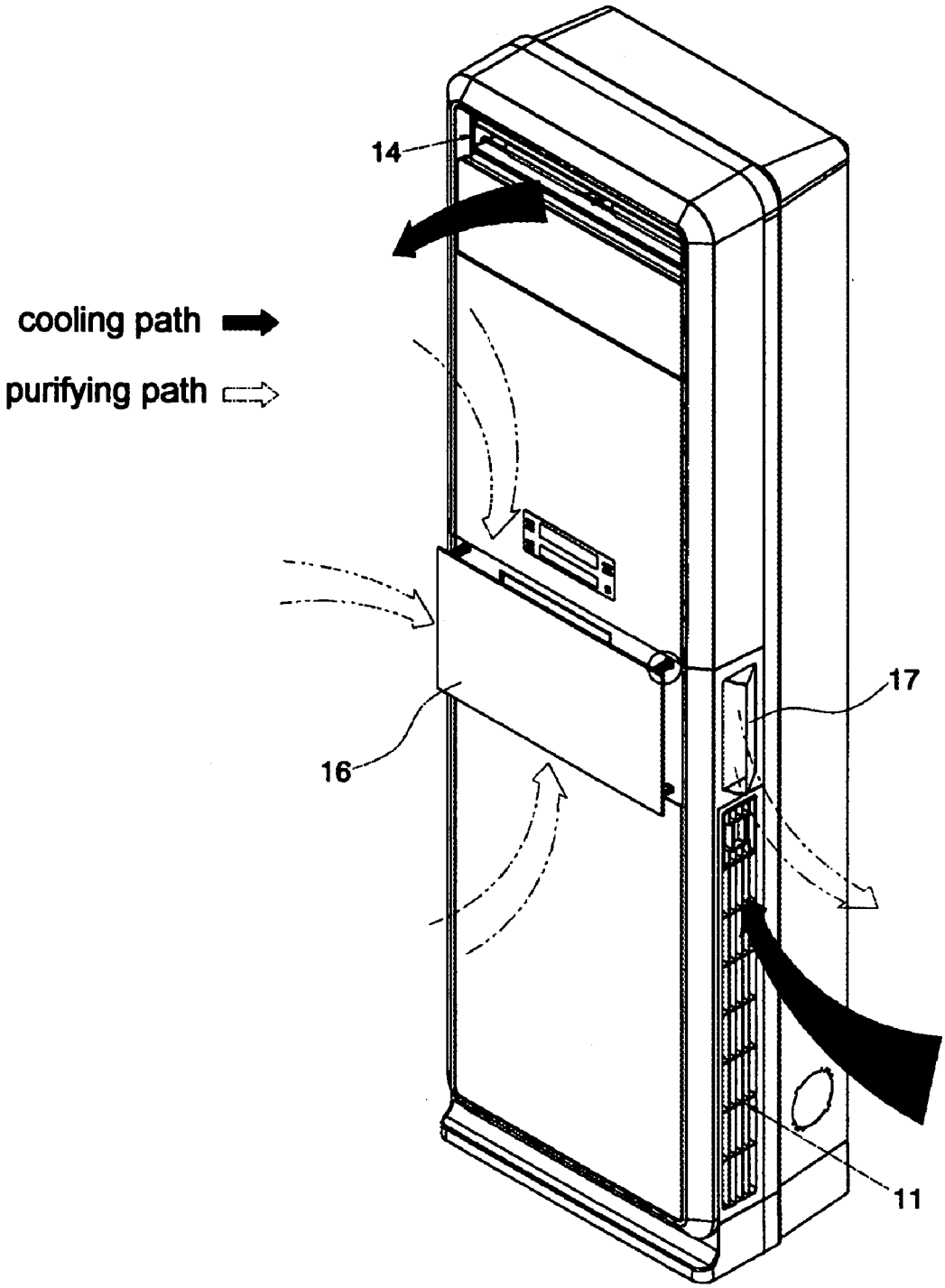
FIG. 6 is a perspective view illustrating cooling and purifying paths of the air conditioner according to the present invention.

FIG. 1 is a perspective view illustrating the outer appearance of an air conditioner according to the present invention. FIG. 2 is a front view schematically illustrating the internal configuration of a body casing shown in FIG. 1. FIG. 3 is an exploded perspective view illustrating important parts of the air conditioner of FIG. 1. FIG. 4 is a partial perspective view illustrating configuration of important parts used to open and close an air purifier employed in the air conditioner according to the present invention. FIG. 5 is a partial perspective view illustrating configuration of important parts used to open and close an air purifier employed in the air conditioner according to an alternative embodiment of the present invention. FIG. 6 is a perspective view illusrating cooling and purifying paths of the air conditioner according to the present invention;

As shown in FIG. 1, the air conditioner according to the present invention comprises a body casing 1 defining the outer appearance of the air conditioner. The body casing 1 consists of a front panel 10 and a rear panel 20, and contains certain parts mounted therein.

That is, the front panel 10, which is configured to cover a front side of the air conditioner, and the rear panel 20, which is configured to cover a rear side of the air conditioner, are engaged and assembled with each other, to form the single integral body casing 1.

In such an engaged and assembled state, the front and rear panels 10 and 20 also define top and bottom sides and opposite lateral sides of the air conditioner.

In particular, the front panel 10 is divided into a lower panel 10*a* and an upper panel 10*b*. The lower and upper panels 10*a* and 10*b* are separately fabricated and are assembled with each other. On the other hand, the rear panel 20 is fabricated as a single case to be assembled with the front panel 10.

The lower panel 10*a* of the front panel 10 is provided, at opposite lateral regions thereof, with suction openings 11 to suction indoor air into the body casing 1, so that the air conditioner has a lateral suction structure.

At a location of the front panel 10, conventionally, at a location of the upper panel 10*b* is provided a display unit 13. The display unit 13 has a display window to display an operational state of the air conditioner, and also has various buttons used to start or stop operation of the air conditioner, to control the blow strength and direction of heat-exchanged air, and to operate an automatic shutter 12.

With the use of the buttons provided at the display unit 13 or a remote controller, independent operation of an air purifier (A), which will be described hereinafter, as well, cooling operation of the air conditioner can be controlled.

The upper panel 10*b* of the front panel 10 is also provided with a discharge opening 14 to discharge cooled air, which is produced by use of a heat exchanger that will be described hereinafter. The automatic shutter 12 is mounted to vertically move along opposite edges of the discharge opening 14, to selectively open and close the discharge opening 14. In the present invention, the automatic shutter 12 is operable regardless of operation of the air conditioner.

A louver frame 40 is provided on the inside of the upper panel 10*b* of the front panel 10. As shown in FIG. 3, the louver frame 40 is spaced apart from an inner wall surface of the rear panel 20 by a predetermined distance (i.e. a space for the flow of cooled air) to define a discharge opening region, and the automatic shutter 12 is fit onto the louver frame 40.

In the discharge opening region of the louver frame 40 are arranged a plurality of horizontal blades 15 to adjust a discharge direction of heat-exchanged cooled air upward and downward, and a plurality of vertical blades (not shown) located behind the horizontal blades 15 to adjust a discharge direction of the cooled air leftward and rightward.

Referring to FIG. 2, a first fan 51 is arranged in the body casing 1 close to a lower end of the body casing 1 by use of a cooler housing 50. Also, a heat exchanger 30 is located above the first fan 51, so that high-temperature indoor air, which is guided upward by the first fan 51, is heat exchanged therein to produce cooled air.

Preferably, the first fan 51 is a cross-flow fan, such as a sirocco fan, rather than an axial-flow fan that is conventionally employed as an electric fan.

To increase a contact area between the heat exchanger and the indoor air, the heat exchanger 30 is obliquely installed, and is seated on a base plate 31.

In the present invention, in particular, the air conditioner comprises an air purifier (A) that is independently operable to purify indoor air. The air purifier is mounted in a middle region of the body casing 1 between the heat exchanger 30 and the first fan 51, more particularly, on the inside of the front panel 10 at a position close to an upper end of the lower panel 10*b*. The air purifier (A) includes a second fan 18, which has a path independent of that of the first fan 51.

Specifically, as shown in FIGS. 2 and 3, the body casing 1 contains a purifier housing 60 for forming the air purifier (A) and the cooler housing 50 for receiving the first fan 51, so that the purifier housing 60 and the cooler housing 50 are integrally formed with each other.

In this case, the purifier housing 60 is positioned at an upper side of the cooler housing 50.

Admittedly, it should be understood that the above described configuration is merely a preferred embodiment, and the purifier housing 60 may be positioned at a lower side of the cooler housing 50 via various design adaptations.

As stated above, in the cooler housing 50 is mounted the first fan 51 to guide high-temperature indoor air, which is suctioned into the body casing 1 via the suction openings 11, upward.

Also, the purifier housing 60, i.e. the air purifier (A), is independently mounted in the middle region of the air conditioner. Thus, a cooling path, along which indoor air is introduced to be cooled in accordance with operation of the first fan 51, can be independently formed of a purifying path, along which indoor air is introduced to be purified in accordance with operation of the second fan 18 of the air purifier (A), without interfering with each other.

The air purifier (A) of the present invention takes the form of the purifier housing 60, and now, more detailed configuration thereof will be explained.

As shown in FIG. 3, the air purifier (A), having an independent path, takes the form of the purifier housing 60 having a scroll structure. The purifier housing 60 is formed with a pair of purified air discharge openings 61 at opposite lateral sides thereof. Arranged in the purifier housing 60 are the second fan 18 having a sirocco fan shape and a motor (not shown) to drive the second fan 18.

The purifier housing 60 is centrally formed with an air purifier suction opening 62, and a front suction cover 16 is provided at a location of the lower panel 10*a* to correspond to the air purifier suction opening 62, so that the air purifier suction opening 62 is opened in accordance with a forward movement of the front suction cover 16 (See FIG. 6). A filter mounting unit 64 is mounted between the front suction cover 16 and the air purifier suction opening 62 of the purifier housing 60, i.e. at an inner wall surface of the lower panel 10*a*. In turn, a filter member 63 is fitted in the filter mounting unit 64 to purify air.

The filter member 63 is a combination of functional filters, such as biological bactericide, optical catalyst, silver-nano, low-temperature catalyst, ultraviolet lamp. Preferably, at least one of the functional filters may be combined.

A pair of lateral discharge covers 17 is provided at opposite lateral sides of the lower panel 10*a* to correspond to the purified air discharge openings 61 of the purifier housing 60, to open and close the purified air discharge openings 61, respectively.

With this configuration, to perform an air purifying operation, first, the front suction cover 61 is moved forward to open the air purifier suction opening 62 for the introduction of indoor air. In such a state, if power is applied to the motor to rotate the second fan 18, indoor air is introduced into the air purifier suction opening 62 after being filtered by the filter member 63 provided in front of the air purifier suction opening 62. Thereby, the purified indoor air is introduced into the purifier housing 60, and can be discharged to a room as the lateral discharge covers 17, which close the pair of purified air discharge openings 61, are opened.

When the air purifier (A) is not operated, the front suction cover 16 and the lateral discharge covers 17, which are used to open and close the air purifier suction opening 62 and the purified air discharge openings 61, respectively, can be simultaneously or individually closed to prevent dust from entering the air purifier suction opening 62 and the purified air discharge openings 61.

The front suction cover 16 is slidably movable forward or rearward relative to the lower panel 10*a*, so that it protrudes forward from the lower panel 10*a* to open the air purifier suction opening 62, and is returned rearward to close the air purifier suction opening 62.

Referring to FIG. 4, detailed configuration to achieve the above opening and closing operations is illustrated As shown in FIG. 4, to allow the front suction cover 16 to slide forward relative to the lower panel 10*a* so as to open the air purifier suction opening 62, the front suction cover 16 is provided with four cover sliders 71 to support respective corner regions of the front suction cover 16, and a pair of slide transfer devices 70 to provide a drive force.

The cover sliders 71 are fixed to the front suction cover 16 to penetrate through the lower panel 10*a*, so that they can support the front suction cover 16 in a slidably movable manner.

Each of the transfer devices 70 includes a first drive motor 72 mounted at the inner wall surface of the lower panel 10*a*, a pinion 73 connected to a shaft of the first drive motor 72, and a rack 74 engaged with the pinion 73. The rack 74 penetrates through the lower panel 10*a* to be fixed perpendicular to an inner surface of the front suction cover 16.

The first drive motor 72 is supported by a supporting structure 75 that is attached to the lower panel 10*a*.

With this configuration, when it is desired to suction indoor air to purify it, the front suction cover 16 is moved forward as the pinions 73 and the racks 74 operate upon receiving a drive force of the first drive motors 72. In this case, the front suction cover 16 is transferred forward relative to the lower panel 10*a* while being supported by the cover sliders 71.

If the front suction cover 16 is moved forward as stated above, a space is defined between the lower panel 10*a* and the front suction cover 16, so that indoor air is introduced into the air purifier suction opening 62 through the space. On the way to be introduced into the air purifier suction opening 62, the indoor air is purified by the filter member 63 fitted in the filter mounting unit 64 of the lower panel 10*a*.

The purified air, having passed through the filter member 63 as stated above, is discharged if the lateral discharge covers 17, provided at opposite lateral sides of the lower panel 10*a*, are opened.

In this case, to independently open and close both the lateral discharge covers 17 regardless of the front suction cover 16, each lateral discharge cover 17 is provided with a second drive motor 76 to produce a drive force, and an opening/closing link 77 to transmit the drive force of the second drive motor 76 to the lateral discharge cover 17.

Although, in an embodiment of the present invention, the lateral discharge covers 17 are configured to be independently opened and closed by the second drive motors 76 regardless of the front suction cover 16, most preferably, the first and second drive motors 72 and 76 must be controlled so that the lateral discharge covers 17 can be opened at the same time as the front suction cover 16 is opened to perform an air purifying operation.

Opening and closing the lateral discharge covers 17 simultaneously with the opening and closing operations of the front suction cover 16 is preferable because it can reduce electricity consumption and enables the use of common drive means.

Referring to FIG. 5, an alternative embodiment of the present invention, which employs linkage structures between the front suction cover 16 and both the lateral discharge covers 17, is illustrated.

As shown in FIG. 5, a transfer rod 81 is connected, at one end thereof to one of the cover sliders 71 that support the front suction cover 16. The other end of the transfer rod 81 is coupled with one end of a connecting rod 82, and in turn, the other end of the connecting rod 82 is connected to the opening/closing link 77 of one of the lateral discharge covers 17.

With the above-described linkage struck between the front suction cover 16 and the lateral discharge covers 17, the second drive motors 76, used to drive the lateral discharge covers 17, can be eliminated.

Hereinafter, the opening/closing procedure obtained by the linkage structures between the front suction cover 16 and the lateral discharge covers 17 will be explained in brief.

First if the front suction cover 16 is moved forward to suction indoor air as the pinions 73 and the racks 74 cooperate upon receiving the drive force of the first drive motors 72, a pair of the transfer rods 81 is moved forward by means of associated cover sliders 71. Simultaneously, the connecting rods 82, which are rotatably and slidably coupled with the transfer rods 81, respectively, are rotated about the opening/closing links 77, so that the lateral discharge covers 17 are rotated and opened in accordance with rotation of the connecting rods 82 connected thereto.

In this case, linear reciprocating motion of the transfer rods 81 and pivotal rotating motion of the connecting rods 82 can be freely performed without interference.

The front suction cover 16 and the lateral discharge cover 17 are closed by performing the above operating procedure in reverse.

The air purifier (A) employed in the air conditioner according to the present invention is configured, as shown in FIG. 6, so that the front suction cover 16 and the air purifier suction opening 62 are provided separately from the lateral discharge covers 17 and the purified air discharge openings 61, and the front suction cover 16 and the lateral discharge covers 17 are opened and closed to suction indoor air to be purified and to discharge the purified air into a room, respectively, resulting in an indent purifying path.

Meanwhile, when a cooling path is independently formed of such a purifying path defined by the air purifier (A), as shown in FIG. 6, cooled air is supplied into a room in accordance with operation of the heat exchanger 30. Similar to a conventional air conditioner, indoor air is suctioned into the body casing 1 via the suction openings 11 in accordance with operation of the first fan 51, and then, flows upward along a duct structure defined in the cooler housing 50.

Thereby, the air is introduced into the heat exchanger 30, which is located in an upper region of the air conditioner, to be heat exchanged.

The heat exchanged cooled air flows upward via an empty space defined behind the louver frame 40 within the body casing 1, and is discharged via the discharge opening 14 of the upper panel 10*b*, to cool a room.

As stated above, in the present invention, the cooling path consists of the suction openings 11, the first fain 51, the heat exchanger 30, and the discharge opening 14, whereas the purifying path consists of the front suction cover 16, the air purifier suction opening 62, the second fan 18, the purified air discharge openings 61, and the lateral discharge covers 17, so that the cooling path is independent of the purifying path. Therefore, with the use of the air conditioner according to the present invention, an air purifying operation and a room cooling operation can be independently or simultaneously carried out in accordance with a user's selective manipulation.

Hereinafter, another preferred embodiment of the present invention will be explained.

Figure 7:
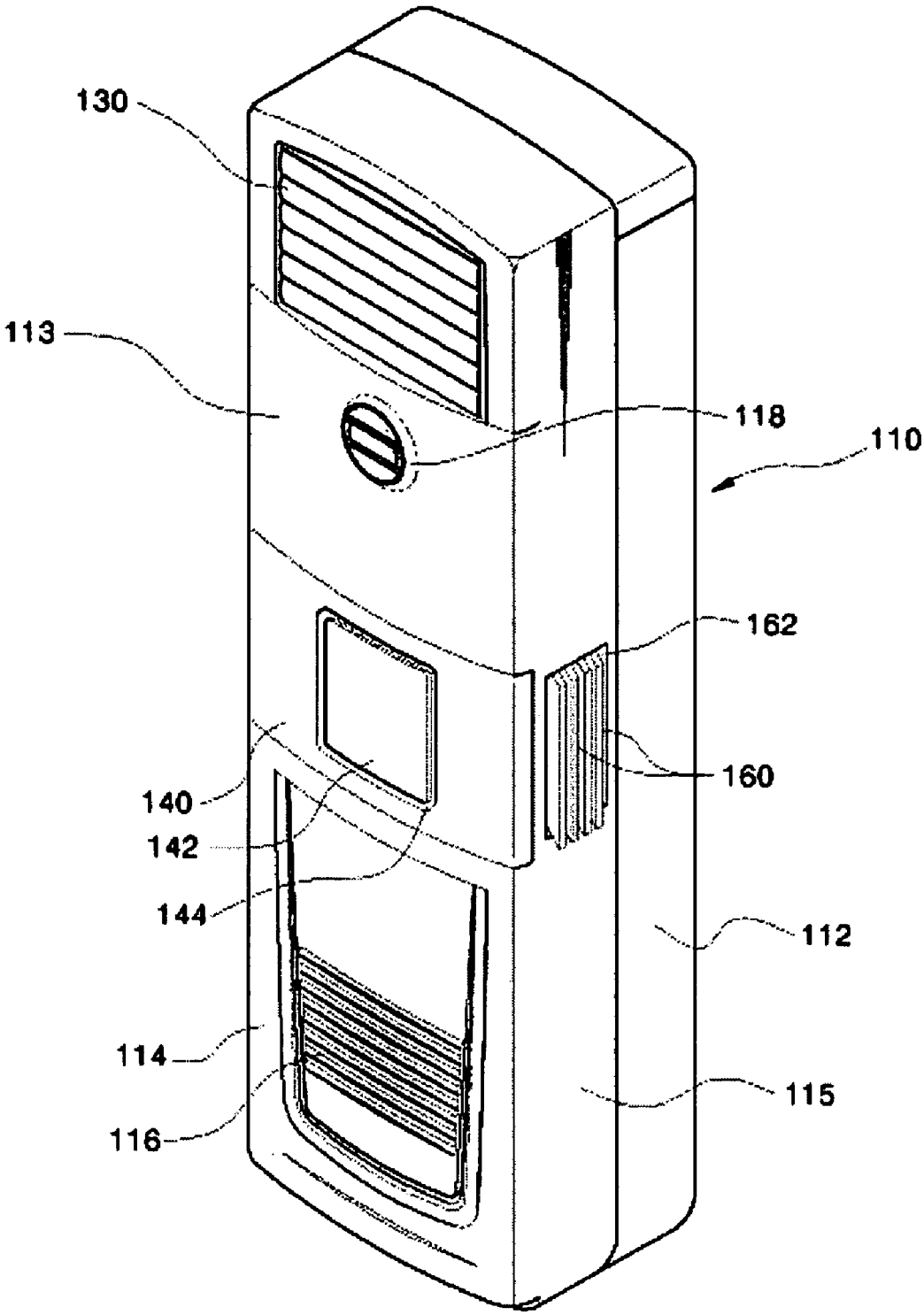
FIG. 7 is a perspective view illusrating the outer appearance of an air conditioner according to another embodiment the present invention.
Figure 8:
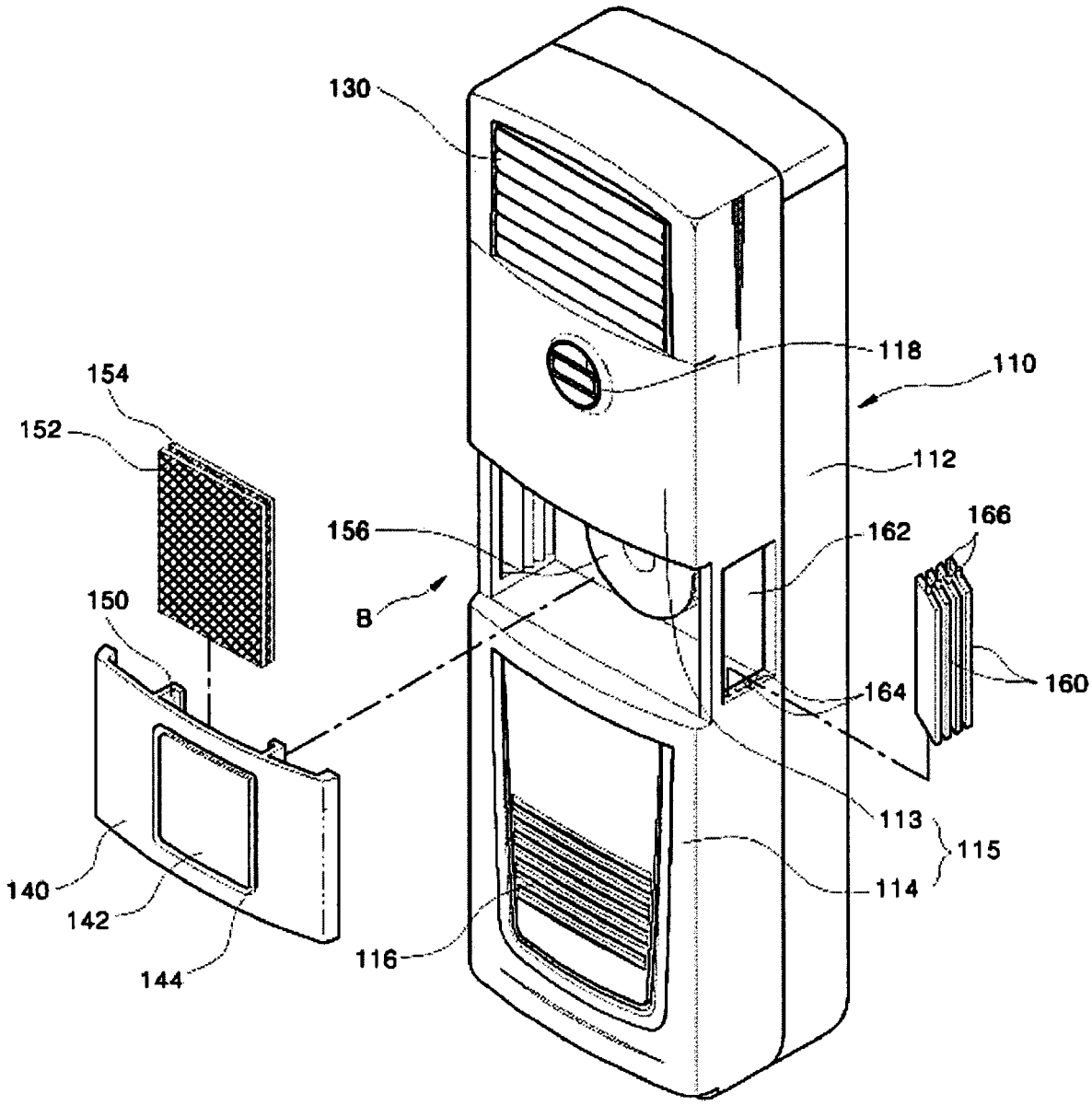
FIG. 8 is an exploded perspective view illustrating important parts of the air conditioner of FIG. 7.
Figure 9:
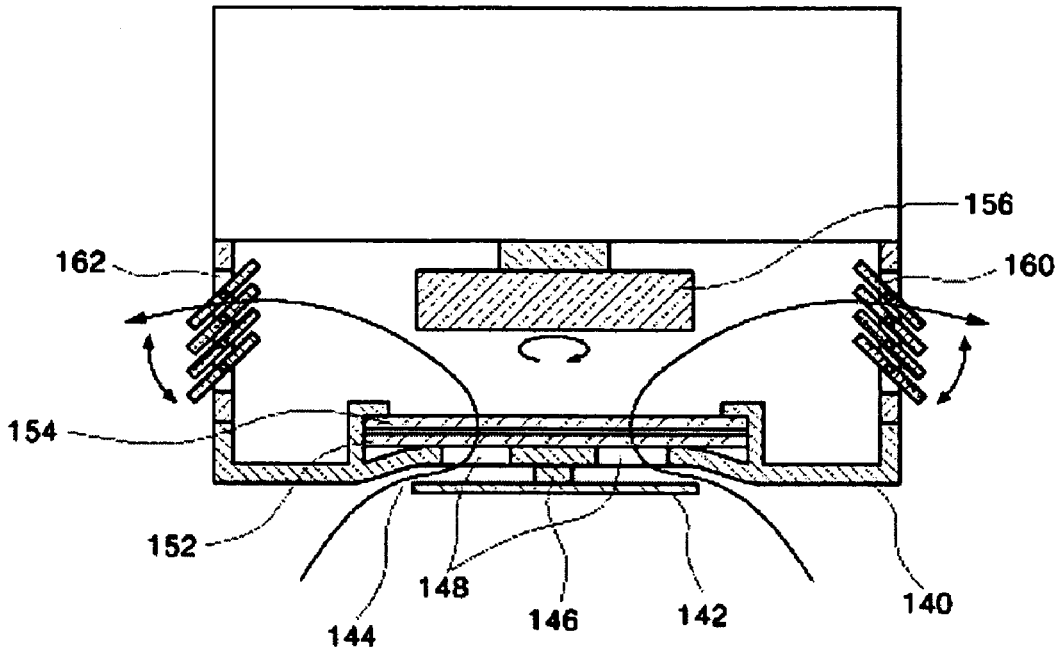
FIG. 9 is a plan sectional view illustrating operational state of an air purifier employed in the air conditioner of FIG. 7.
Figure 10:
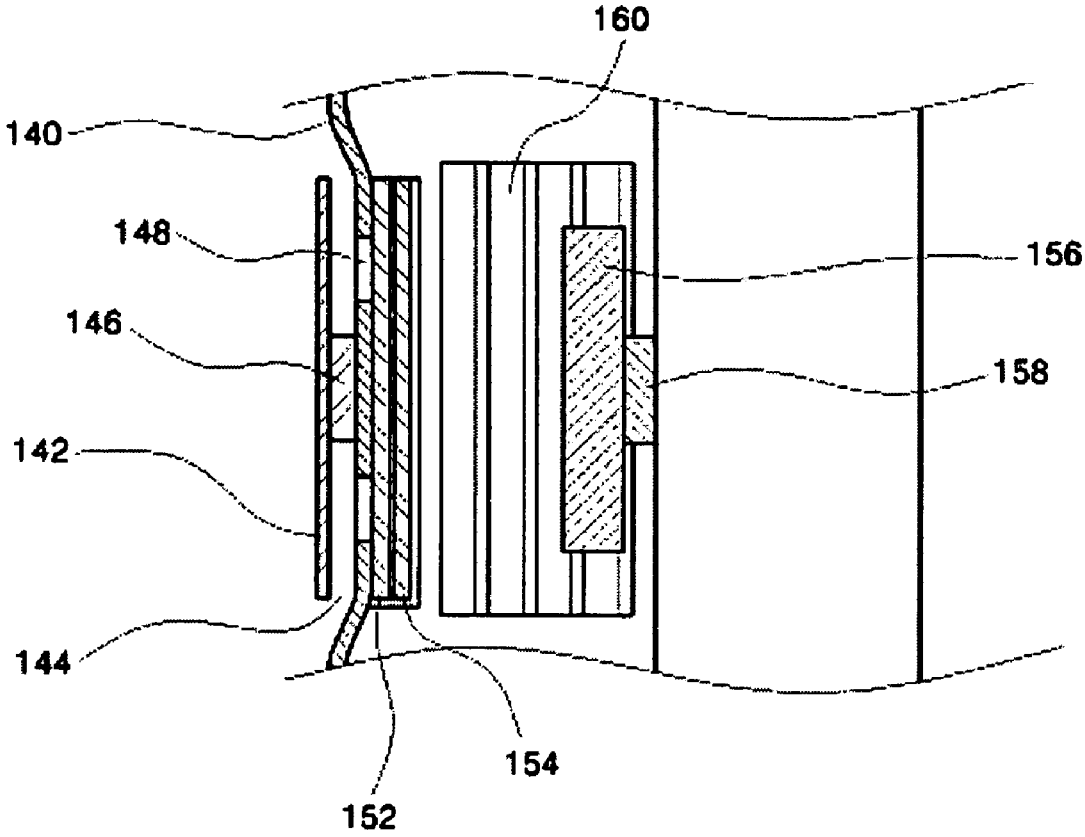
FIG. 10 is a side sectional view illustrating operational state of an air purifier employed in the air conditioner of FIG. 7.

FIG. 7 is a perspective view illustrating the outer appearance of an air conditioner according to another embodiment the present invention. FIG. 8 is an exploded perspective view illustrating important parts of the air conditioner of FIG. 7. FIG. 9 is a plan sectional view illustrating operational state of an air purifier (B) employed in the air conditioner of FIG. 7. FIG. 10 is a side sectional view illustrating operational state of an air purifier (B) employed in the air conditioner of FIG. 7.

As shown in FIGS. 7 and 8, the air conditioner according to another embodiment of the present invention comprises a suction opening 116 centrally provided at a lower panel 114 of the air conditioner to suction air, and a discharge opening 130 centrally formed at an upper panel 113 to discharge cooled air obtained by heat exchanging the air suctioned from the suction opening 116 by use of a heat exchanger. A front suction cover 140 is located at an upper side of the lower panel 114 so that it can be coupled to or be separated from a rear panel 112. The front suction cover 140 is provided with a separated cover member 142 to define an air purifier suction opening 144 and air purifier suction holes 148. A filter member 152 is mounted on the inside of the front suction cover 140 to filter impurities contained in the suctioned air. Also, an electric dust collector 154 is located close to the filter member 152 to sterilize and purify air by applying electrical simulations. A second fan 156 is mounted on the inside of the front suction cover 140 to blow the purified air having passed through the filter member 152 and the electric dust collector 154. To discharge the air, blown by the second fan 156, via opposite lateral sides of a front panel 115 of the air conditioner, a pair of purified air discharge grills 160 is provided at the opposite lateral sides of the front panel 115.

The cover member 142 is fixed to a front side of the front suction cover 140 by use of a supporting bar 146.

Both the filter member 152 and the electric dust collector 154 are vertically inserted into or separated from a guide groove 150. The guide groove 150 is defined at an inner surface of the front suction cover 140 by means of a pair of bent guide walls.

Each of the purified air discharge grills 160 has fixing protrusions 166 formed at upper and lower surfaces thereof The fixing protrusions 166 are inserted into and rotatably fixed in fixing recesses 164 formed at the front panel 115.

Hereinafter, operation and effects of the air conditioner according to another embodiment of the present invention having the above described configuration will be explained.

As shown in FIGS. 9 and 10, when the air conditioner according to the present invention is operated to perform a cooling function, a display unit 118, which is mounted at the upper panel 113 of the front panel 115, is manipulated to drive the first fan, so that air is suctioned via the suction opening 116 and is blown to a heat exchanger.

Thereby, cooled air is produced in accordance with operation of the heat exchanger, and is discharged via the discharge opening 130 to cool a room.

Meanwhile, to perform an air purifying function while performing the cooling function or after stopping the cooling function, the display unit 118 is manipulated to drive the second fan 156, so that air is suctioned via the air purifier suction opening 144 and the air purifier suction holes 148 defined by the cover member 142 of the front suction cover 140.

The suctioned air, having passed through the air purifier suction holes 148, is primarily filtered while passing through the filter member 152, to remove impurities such as dust, and then, is secondarily sterilized and purified while passing through the electric dust collector 154 to remove viruses or bacteria in accordance with electrical actions. After that, the purified air is blown in leftward and rightward directions about the second fan 156, thereby being discharged into opposite leftward and rightward directions via the purified air discharge grills 160 mounted in purifier discharge openings 162 that are formed at opposite lateral sides of the front panel 115.

A discharge direction of the purified air from the purified air discharge grills 160 can be simply changed by rotating the purified air discharge grills 160 to face in a desired direction.

Since the fixing protrusions 166 are rotatably fixed in the fixing recesses 164, the purified air discharge grills 160 can be rotated to discharge the purified air into the desired direction.

Both the filter member 152 and the electric dust collector 154 can be simply separated from the air conditioner in the case of cleaning by separating the front suction cover 140 from the front panel 115 of the air conditioner, and then, pulling the filter member 152 and the electric dust collector 154 out of the guide groove 150. After removal of impurities such as dust, the filter member 152 and the electric dust collector 154 can be remounted in the air conditioner.

As stated above, the air conditioner of the present invention has an advantage in that it can independently or simultaneously perform room cooling and air purifying functions.

As is apparent from the above description, the present invention provides an air conditioner wherein a cooling path, which consists of one or more suction openings, a first fan, a heat exchanger, and a discharge opening, is independently formed of a purifying path, which consists of a front suction cover, an air purifying suction opening, a second fan, a pair of purified air discharge openings, and a pair of lateral discharge covers, whereby, in use of the air conditioner, air purifying and room cooling operations can be independently or simultaneously carried out in accordance with a user's selective manipulation.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An air conditioner having independent cooling and purifying paths, comprising: a body casing consisting of a front panel and a rear panel assembled with each other; a first fan arranged in the body casing to suction air; and a heat exchanger located above the first fan to perform heat exchange of the suctioned air, wherein the cooling path includes one or more suction openings formed at a lower section of the body casing and a discharge opening formed at a front side of an upper section of the body casing, wherein the purifying path includes an air purifier suction opening, which is formed at a lateral location or a center location of the front side of the body casing, and a pair of purified air discharge openings, which are formed at opposite lateral sides of the body casing, and wherein the cooling path is separated from the purifying path to be independently formed from each other.

2. The air conditioner as set forth in claim 1, wherein a pair of suction openings of the cooling path is formed at opposite lateral sides of the front panel to be located in the lower section of the body casing.

3. The air conditioner as set forth in claim 1, wherein a single suction opening of the cooling path is formed at a front side of the front panel to be located in the lower section of the body casing.

4. An air conditioner having independent cooling and purifying paths, comprising: a body casing formed by assembling a front panel with a rear panel, the front panel having a cooled air discharge opening and one or more suction openings to introduce indoor air into the body casing; a first fan arranged in the body casing to suction air via the suction openings; and a heat exchanger located above the first fan to perform heat exchange of the suctioned air, wherein a cooler housing is arranged in the body casing to receive the first fan therein:

wherein an air purifier is mounted in the body casing, the air purifier including: a purifier housing formed with an air purifier suction opening to suction air and a pair of purified air discharge openings to discharge purified air, separately from the suction openings and the discharge opening; a second fan mounted in the purifier housing to suction air; and a filter member located in front of the air purifier suction opening to filter air;

whereby the cooling path, which consists of the suction openings, the first fan, the heat exchanger, and the discharge opening, is independently formed of the purifying path, which consists of the filter member, the air purifier suction opening, the second fan, and the purified air discharge openings.

5. The air conditioner as set forth in claim 4, wherein the air purifier suction opening is opened and closed in accordance with driving of a front suction cover, which is mounted to slide forward from the body casing, and wherein the purified air discharge openings are opened and closed in accordance with driving of a pair of lateral discharge covers, which are mounted to pivotally rotate at opposite lateral sides of the body casing.

6. The air condition as set forth in claim 4, wherein the suction openings of the front panel are formed at opposite lateral sides of the body casing.

7. The air condition as set forth in claim 4, wherein the cooler housing and the purifier housing are integrally formed with each other to be mounted in the body casing.

8. The air condition as set forth in claim 7, wherein the purifier housing is positioned at an upper side of the cooler housing.

9. The air condition as set forth in claim 4, wherein indoor cooling and air purifying operations obtained via the cooling path and the purifying path are independently or simultaneously performed in accordance with a user's selective manipulation.

10. The air condition as set forth in claim 5, wherein the front suction cover is opened and closed by: four cover sliders mounted to slide forward from the front panel to support respective corners of the front suction cover; a pair of first drive motors each attached to a supporting structure provided at an inner surface of the front panel; a pair of pinions each connected to a shaft of one of the first drive motors; and a pair of racks engaged with the pinions, respectively, each rack penetrating through the front panel to be fixed perpendicularly to the inner surface of the front suction cover, and wherein each of the lateral discharge covers is opened and closed by: a second drive motor provided at a side of the lateral discharge cover; and an opening/closing link to transmit a drive force of the second drive motor to the lateral discharge cover.

11. The air condition as set forth in claim 5, wherein the front suction cover is opened and closed by: four cover sliders mounted to slide forward from the front panel to support respective corners of the front suction cover; a pair of first drive motors each attached to a supporting structure provided at an inner surface of the front panel; a pair of pinions each connected to a shaft of one of the first drive motors; and a pair of racks engaged with the pinions, respectively, each rack penetrating through the front panel to be fixed perpendicularly to the inner surface of the front suction cover, and wherein each of the lateral discharge covers is opened and closed by: a transfer rod having one end fixed to one of the cover sliders; a connecting rod having one end coupled with the other end of the transfer rod; and an opening/closing link provided at the lateral discharge cover to be connected to the other end of the connecting rod, whereby the lateral discharge covers are linked with the front suction cover to be opened and closed in accordance with operation of the front suction cover.

12. An air conditioner having independent cooling and purifying paths, comprising:

one or more suction openings to suction air via a lower panel of a front panel;

a discharge opening to discharge cooled air after cooling the air suctioned via the suction openings by use of a heat exchanger;

a front suction cover mounted at an upper side of the lower panel to be coupled to and separated from a rear panel, the front suction cover having a separated cover member to define an air purifier suction opening and air purifier suction holes;

a filter member mounted on the inside of the front suction cover to filter impurities contained in the suctioned air;

an electric dust collector mounted close to the filter member to sterilize and purify air by applying electrical stimulations;

a second fan mounted on the inside of the front suction cover to blow air purified by the filter member and the electric dust collector; and a pair of purified air discharge grills to guide the air, blown from the second fan, to discharge it from opposite lateral sides of the front panel.

13. The air conditioner as set forth in claim 12, wherein the cover member is fixed to a front side of the suction cover by use of a supporting bar.

14. The air conditioner as set forth in claim 12, wherein the filter member and the electric dust collector are configured to be inserted into or be separated from a guide groove, which is defined at an inner surface of the front suction cover by means of a pair of bent guide walls.

15. The air conditioner as set forth in claim 12, wherein each of the purified air discharge grills has fixing protrusions formed at upper and lower surfaces thereof, so that the fixing protrusions are inserted into and rotatably fixed in fixing recesses formed at the front panel.

16. The air condition as set forth in claim 5, wherein the suction openings of the front panel are formed at opposite lateral sides of the body casing.

* * * * *